US010385696B2

(12) United States Patent
Edwards

(10) Patent No.: US 10,385,696 B2
(45) Date of Patent: Aug. 20, 2019

(54) ROTOR DAMPER

(71) Applicant: ROLLS-ROYCE plc, London (GB)

(72) Inventor: Garry Mark Edwards, Clevedon (GB)

(73) Assignee: ROLLS-ROYCE plc, London (GB)

( * ) Notice: Subject to any disclaimer, the term of this patent is extended or adjusted under 35 U.S.C. 154(b) by 624 days.

(21) Appl. No.: 15/077,131

(22) Filed: Mar. 22, 2016

(65) Prior Publication Data

US 2016/0298458 A1 Oct. 13, 2016

(30) Foreign Application Priority Data

Apr. 13, 2015 (GB) ..... 1506197.1

(51) Int. Cl.
*F01D 5/10* (2006.01)
*F01D 5/16* (2006.01)
(Continued)

(52) U.S. Cl.
CPC ..... *F01D 5/10* (2013.01); *F01D 5/16* (2013.01); *F01D 5/30* (2013.01); *F01D 5/34* (2013.01);
(Continued)

(58) Field of Classification Search
CPC ..... F01D 5/10; F01D 5/16; F01D 5/26; F01D 5/30; F01D 5/34; F01D 25/04;
(Continued)

(56) References Cited

U.S. PATENT DOCUMENTS 4,192,633 A * 3/1980 Herzner ..... F01D 5/10 415/119
5,114,159 A * 5/1992 Baird ..... F01D 5/10 277/355
(Continued)

FOREIGN PATENT DOCUMENTS

EP 1180579 A2 2/2002
EP 2 540 980 A2 1/2013
(Continued)

OTHER PUBLICATIONS

Oct. 14, 2016 Extended European Search Report issued in European Patent Application No. 16164498.4.
(Continued)

*Primary Examiner* — Jason D Shanske
*Assistant Examiner* — Sang K Kim
(74) *Attorney, Agent, or Firm* — Oliff PLC

(57) ABSTRACT

A rotor stage (100) of a gas turbine engine (10) comprises a platform (120) from which rotor blades extend. The platform is provided with a circumferentially extending damper ring (200), the damper ring having an engagement surface (210) that engages with a platform engagement surface (110) of the platform (120). The platform engagement surface (110) and the damper engagement surface (210) can move relative to each other in the radial direction. In use, the damper engagement surface (210) moves less in the radial direction than the platform engagement surface (110) in response to diametral mode excitation. This causes friction between the
(Continued)

two surfaces, thereby dissipating energy and damping the excitation.

20 Claims, 5 Drawing Sheets

(51) Int. Cl.
*F01D 5/30* (2006.01)
*F01D 5/34* (2006.01)

(52) U.S. Cl.
CPC ..... *F05D 2220/32* (2013.01); *F05D 2240/20* (2013.01); *F05D 2240/80* (2013.01); *F05D 2260/96* (2013.01)

(58) Field of Classification Search
CPC .. F01D 25/06; F05D 2220/32; F05D 2240/20; F05D 2240/80; F05D 2260/96
See application file for complete search history.

(56) References Cited

U.S. PATENT DOCUMENTS

| | | | | |
|---|---|---|---|---|
| 5,562,419 | A | 10/1996 | Crall et al. | |
| 5,733,103 | A | 3/1998 | Wallace et al. | |
| 6,375,428 | B1 * | 4/2002 | Stangeland | F01D 5/10 416/190 |
| 6,471,484 | B1 | 10/2002 | Crall | |
| 6,494,679 | B1 | 12/2002 | Gadre et al. | |
| 7,527,476 | B2 | 5/2009 | Butt et al. | |
| 7,758,311 | B2 | 7/2010 | Loehle et al. | |
| 8,333,563 | B2 | 12/2012 | Razzell | |
| 9,151,170 | B2 | 10/2015 | El-Aini et al. | |
| 2009/0004013 | A1 * | 1/2009 | Ramlogan | F01D 5/22 416/190 |
| 2012/0057988 | A1 | 3/2012 | Stiehler | |
| 2016/0298457 | A1 * | 10/2016 | Edwards | F01D 5/10 |
| 2017/0211592 | A1 * | 7/2017 | Klauke | F02K 3/06 |
| 2017/0306772 | A1 * | 10/2017 | Fulayter | F01D 5/34 |
| 2018/0230831 | A1 * | 8/2018 | Kush | F01D 5/34 |

FOREIGN PATENT DOCUMENTS

| | | | |
|---|---|---|---|
| EP | 2 662 533 | A2 | 11/2013 |
| GB | 670 665 | A | 4/1952 |
| GB | 2 255 138 | A | 10/1992 |
| GB | 2 455 431 | A | 6/2009 |
| JP | S5720504 | A | 2/1982 |
| JP | H05-30813 | A | 2/1993 |

OTHER PUBLICATIONS

Jun. 6, 2018 Office Action issued in US. Appl. No. 15/094,415.
U.S. Appl. No. 15/094,415, filed Apr. 8, 2016 in the name of Michael F. Bryant, et al.
U.S. Appl. No. 15/094,393, filed Apr. 8, 2016 in the name of Michael F. Bryant, et al.
Oct. 20, 2015 Search Report issued in British Patent Application No. 1506197.1.
Oct. 12, 2016 Search Report issued in European Patent Application No. 16164497.
Nov. 14, 2016 Partial Search Report issued in European Patent Application No. 16 16 1162.
Oct. 18, 2018 Office Action issued in U.S. Appl. No. 15/094,393.
May 1, 2019 Office Action issued in U.S. Appl. No. 15/094,393.

* cited by examiner

ROTOR DAMPER

CROSS-REFERENCE TO RELATED APPLICATIONS

This application is based upon and claims the benefit of priority from British Patent Application Number 1506197.1 filed 13 Apr. 2015, the entire contents of which are incorporated by reference.

BACKGROUND

1. Field of the Disclosure

The present disclosure concerns a damper for a rotating part of a gas turbine engine.

2. Description of the Related Art

A gas turbine engine comprises various stages of rotor blades which rotate in use. Typically, a gas turbine engine would have at least one compressor rotor stage, and at least one turbine rotor stage.

There are a number of ways in which the blades of a rotor stage may be attached to the engine. Generally, the blades attach to a rotating component, such as a disc, that is linked to a rotating shaft. Conventionally, blades have been inserted and locked into slots formed in such discs.

Integral bladed disc rotors, also referred to as blisks (or bliscs), have also been proposed. Such blisks may be, for example, machined from a solid component, or may be manufactured by friction welding (for example linear friction welding) of the blades to the rim of the disc rotor.

Blisks have a number of advantages when compared with more traditional bladed disc rotor assemblies. For example, blisks are generally lighter than equivalent bladed disc assemblies in which the blades are inserted and locked into slots in the disc because traditional blade to disc mounting features, such as dovetail rim slots, blade roots, and locking features are no longer required. Blisks are therefore increasingly used in modern gas turbine engines, for example as part of the compressor section (including the fan of a turbofan engine).

Typically blisks are designed where possible to avoid vibration responses from, for example, resonance and flutter, which may be distortion driven. However, blisks lack inherent damping when compared to conventional bladed disc assemblies and resonances and flutter cannot always be avoided.

Additionally, the outer surface or rim of the blisk disc portion typically forms the inner annulus for working fluid in the gas turbine engine, such as at the compressor inlet. Thus the requirement for the inner annulus position fixes the blisk outer rim radius from the engine centre line thereby determining the basic size/shape of the disc portion. Accordingly, it may not be possible to design a blisk that avoids all forced vibration responses within such constraints.

OBJECTS AND SUMMARY

Accordingly, it is desirable to be able to provide efficient and/or effective damping to a rotor stage, for example to a bladed disc, or blisk.

According to an aspect, there is provided a rotor stage for a gas turbine engine. The rotor stage comprises a plurality of blades extending from a platform. The platform extends circumferentially about an axial direction. The rotor stage comprises a damper element. The platform comprises a platform engagement surface that extends in a plane that is substantially perpendicular to the axial direction. The damper element comprises a damper engagement surface that extends in a plane that is parallel to the platform engagement surface. The damper element engagement surface may be said to be substantially perpendicular to the axial direction. The damper engagement surface engages the platform engagement surface. The damper engagement surface and the platform engagement surface are moveable relative to each other in a radial direction. The platform is more radially deformable than the damper element under diametral mode excitation of the rotor stage.

Excitation of the rotor stage may cause relative movement (which may be referred to as relative radial movement) between the damper engagement surface and the platform engagement surface. This relative movement may be caused by radial movement (which may be and/or include radial oscillation (including, for example, elliptical oscillation) at a given circumferential position) of the platform engagement surface due to the diametral mode vibration/excitation. The damper engagement surface may be substantially stationary, at least in the radial direction and/or at least relative to the movement (for example radial movement) of the platform engagement surface. The damper element (and/or the damper engagement surface) may be said to be more radially fixed and/or less radially mobile and/or more dimensionally stable in the radial direction and/or more radially rigid (or less radially flexible than the platform (and/or the platform engagement surface), for example in response to diametral mode excitation.

The damper engagement surface and the platform engagement surface may be moveable relative to each other (and, for example, may actually move relative to each other in use) in the circumferential direction. Thus, for example, the damper engagement surface and the platform engagement surface may be moveable relative to each other in both the circumferential direction and the radial direction. Purely by way of example, in use, the movement of two initially coincident points—one on the damper engagement surface and the platform engagement surface—may take an elliptical shape. Also by way of example, the major axis of such an ellipse may be in the radial direction. The slip may be described as being predominantly in the radial direction.

Relative movement between the platform engagement surface and the damper engagement surface may result in frictional damping. Such frictional damping may be provided due to frictional losses being generated at the interface between the two surfaces as they move, and thus rub against, each other. Such frictional damping may be effective in damping vibration (for example diametral mode vibration) in the rotor stage during use, for example during use in a gas turbine engine. Accordingly, the arrangements and/or methods described and/or claimed herein may provide improved damping.

As noted above, the damper engagement surface and the platform engagement surface are substantially perpendicular to the axial direction. This may mean that the damper engagement surface and the platform engagement surface are perpendicular to the axial direction and/or have a major component perpendicular to the axial direction. The surface normal to the damper engagement surface and the platform engagement surface may be slightly inclined to the axial direction (for example by less than 20 degrees, for example less than 10 degrees, for example less than 5 degrees, for example less than 2 degrees), so as to, for example, have a radial component. Such slightly inclined engagement surfaces may be described as being conical, as well as being substantially perpendicular to the axial direction.

In some arrangements, the damper element may contact the platform only where the damper engagement surface and the platform engagement surface engage.

According to an aspect, there is provided a method of damping vibrations in a rotor stage of a gas turbine engine, wherein the rotor stage is a rotor stage as described and/or claimed herein. According to such a method, the vibration may comprise a travelling wave passing circumferentially around the circumferentially extending platform. Such wave may be an example of and/or may result from diametral mode excitation/vibration. According to such a method, the damping is provided by frictional damping generated through slip between the platform engagement surface and the damper engagement surface. The slip may comprise radial slip. The slip may comprise circumferential slip, for example in addition to radial slip.

The magnitude of the frictional damping may depend upon, for example, the load with which the surfaces are pushed together and/or the amount of relative movement between the surfaces.

According to an aspect, there is provided a method of designing a rotor stage of a gas turbine engine, the rotor stage having a plurality of blades extending from a platform, the platform extending circumferentially about an axial direction and comprising a platform engagement surface that extends in a plane that is substantially perpendicular to the axial direction. The method comprises providing a rig having the same vibration response and platform engagement surface as the platform. The method comprises providing a damper element comprising a damper engagement surface that extends in a plane that is parallel to the platform engagement surface and engages with the platform engagement surface. The rig is more radially deformable than the damper element under diametral mode excitation. The method comprises providing an axial biasing force to push the damper engagement surface and platform engagement surface together. The method comprises providing diametral mode excitation to the rig and measuring the damping provided by the damper element. The method comprises repeating the step of providing diametral mode excitation and damping measurement at different axial biasing forces. The method comprises using the damping measurements to determine the optimal axial biasing force required to provide optimal damping of the diametral mode excitation.

According to such a method of designing a rotor stage, the rig could simply be a replica (or actual) version of the rotor stage that is being designed. The flexibility (or stiffness) of the rig may be the same as that of the platform (including, for example, the attached blades) that is being designed, at least in relation to its radial flexibility/stiffness.

The step of providing diametral mode excitation may be performed in any manner (for example any known manner) and/or may be performed at a range of different frequencies for each axial biasing force. The frequency or frequencies at which the excitation is provided may be one or more target frequencies, which may be natural frequencies of the rotor stage (or at least of the platform and blades) and/or frequencies that would be excited during operation of the rotor stage, for example in a gas turbine engine.

The damping may be measured using any suitable method (for example any known method), for example through determination of the damping ratio.

According to an aspect, there is provided a method of manufacturing a rotor stage of a gas turbine engine comprising: providing a platform extending circumferentially about an axial direction, the platform having a plurality of blades extending therefrom and a platform engagement surface that extends in a plane that is substantially perpendicular to the axial direction; and providing a damper element having a damper engagement surface that extends in a plane that is parallel to the platform engagement surface and engages with the platform engagement surface. The method further comprises biasing the damper engagement surface and platform engagement surface together. The force with which the damper engagement surface and the platform engagement surface together are biased together may be the optimal biasing force as determined by the methods and/or apparatuses described and/or claimed herein. Any suitable arrangement may be used to provide the biasing force, including any of the arrangements described and/or claimed herein, such as a biasing element (for example a spring) or a controlled interference fit.

Where the term axial direction is used herein, this may be the same as the rotational axis about which the rotor stage rotates in use and/or the rotational axis of a gas turbine engine to which the rotor stage may be provided. The terms radial and circumferential as used herein are relative to axial direction/rotational axis. The platform engagement surface and/or the damper engagement surface may be said to extend substantially in the radial-circumferential plane. The platform engagement surface and the damper engagement surface may be moveable relative to each other in the radial direction. For example, the platform engagement surface and the damper engagement surface may be substantially fixed relative to each other in the axial direction.

The damper element may have a generally annular shape. The damper element may extend around all, or a majority, of the circumference of the rotor stage. The damper element (which may be referred to simply as a damper) may be a damper ring. Such a damper ring may be a continuous (unbroken) ring or a split ring.

The damper element may comprise openings or holes. For example, the damper element may comprise substantially axially aligned holes (that is, holes with an axis extending in the direction of the rotational axis of the rotor stage, for example perpendicular to the major surfaces of the damper element) that extend through the rest of the damper element. For example, the damper element may be a substantially annular (or disc-shaped) body with holes extending therethrough. Such holes may provide access to regions that would otherwise be sealed and/or difficult to access due to the presence of the damper element, for example to access fixings such as bolts. Additionally or alternatively, such holes may provide ventilation and/or cooling to regions that would otherwise be substantially sealed by the damper element, for example a region between the damper element and a drive/root portion of the rotor stage, as shown by way of example in the Figures.

A rotor stage as described and/or claimed herein may be provided with one or more than one damper element. Where more than one damper element is provided, two damper elements may be axially offset from each other.

The platform may have a radially inner surface. The platform engagement surface may be formed in the radially inner surface. The damper element may be provided to the radially inner surface. The damper element and/or platform engagement surface may be on the opposite side of the platform to that from which the blades extend.

The platform engagement surface may be annular (or a segment of an annulus). The damper engagement surface may be annular (or a segment of an annulus). The platform engagement surface and the damper engagement surface may have the same shape and/or may have overlapping shapes.

The platform engagement surface and/or the damper engagement surface may take any desired shape. Purely by way of further example, the platform engagement surface (and/or the damper engagement surface) may have a curved, or "barrelled" shape when viewed in cross-section perpendicular to the circumferential direction. In such an arrangement, the engagement of the damper engagement surface with the platform engagement surface may be along a line, for example a circle or a segment of a circle.

The damper element may be (for example have a shape that is) particularly resistant to deformation or deflection (for example particularly stiff or rigid) in the radial direction. The damper element may be (for example have a shape that is) particularly resistant to deformation (for example particularly stiff or rigid) perpendicular to the axial direction. Particularly resistant to deformation may mean that it is more resistant to deformation in that direction that to deformation in other directions.

The damper element may have any suitable cross-sectional shape. For example, the damper element may have a cross-sectional shape in a plane perpendicular to the circumferential direction of the rotor stage that is stiffer (for example has a higher second moment of area) about an axially extending bending axis than about a radially extending bending axis. The damper element may, for example, have a rectangular shaped, T-shaped or I-shaped cross section, although a great many other cross-sections are possible, of course.

The dimension (or extent) of the cross-section in the radial direction of such a cross-section may be greater than the dimension (or extent) of the cross-section in the axial direction.

The damper element may be a thin-walled annular disc. The thin wall (which may be referred to as the thickness) may be said to be in the axial direction. The axial thickness of such a thin-walled annular disc may be, for example, less than (for example less than 25%, 20%, 15%, 10%, 5% or 2% of) the distance between the inner and outer radii of the annulus.

The damper element may comprise at least one stiffening rib. For example, such a stiffening rib may extend axially. Such a stiffening rib may extend around all or a part of the circumference.

The damper element may be manufactured using any suitable material. For example, the damper element may be manufactured using a single material and/or may be said to be homogeneous. The damper element may comprise two (or more than two) different materials.

The damper element may have a body portion and an engagement portion. The engagement portion may comprise the damper engagement surface that is in contact with the platform. Regardless of the material of the damper element (for example whether it is manufactured using one, two, or more than two materials), the engagement surface may be the surface that slips relative to the platform during excitation (or vibration) of the platform. In arrangements in which the damper element comprises a body portion and an engagement portion, the engagement portion may be manufactured using a first material, and the body portion may be manufactured using a second material. In such an arrangement, and purely by way of example only, the first material may be metal and/or the second material may be a composite, such as a fibre reinforced and/or polymer matrix composite, such as carbon fibre. In such an arrangement, the body portion and the engagement portion may, for example, be bonded together.

The damper element may be radially fixed to a dimensionally stable part of the gas turbine engine, for example to a part of the gas turbine engine that is not susceptible to diametral mode vibration during operation. Examples of the present disclosure may comprise a drive assembly. Such a drive assembly may be arranged to transfer rotational drive, for example to (or from) the platform and/or the blades mounted thereto. Such a drive assembly may be considered to be a part of the rotor stage, for example where at least a part of it is used to drive the rotor stage. The rotational drive may, for example, be transferred from a shaft (which may be referred to as a rotating shaft) of the gas turbine engine, which may be connected between the turbine and the compressor of a gas turbine engine so as to transfer power therebetween. In operation, the drive assembly typically rotates at the same rotational speed as the rotor stage that it is driving. The damper element may be radially fixed (for example connected or attached) to such a drive assembly.

The drive assembly may be very dimensionally stable, for example experiencing substantially no radial movement during operation, even if, for example, other parts of the gas turbine engine and/or rotor stage are experiencing diametral mode vibration. The drive assembly may be considered to be rigid, at least in a radial sense, for example substantially more rigid than other parts of the rotor stage, including the platform. Accordingly, radially fixing the damper element to the drive assembly may assist in limiting (or substantially eliminating) the radial movement of the damper element during operation, although it will be appreciated that radial fixing of the damper element to the drive assembly is not essential for the operation.

In any arrangement described and/or claimed herein, the damper element may extend from a radially inner end (which may be a circle/cylindrical surface/frusto cone or a segment of a circle/cylindrical surface/frusto cone) to a radially outer end which may be a circle/cylindrical surface/frusto cone or a segment of a circle/cylindrical surface/frusto cone). In arrangements in which the damper element is radially fixed to the drive assembly, it may be a radially inner end region of the damper element that is radially fixed to the drive assembly. The damper element may thus be (and/or be manufactured as) a separate component to the rest of the rotor stage, and subsequently attached to the rotor stage by any suitable method.

A drive assembly may comprise a fixing hook. The damper element may comprise a fixing hook that corresponds to the drive assembly fixing hook. The drive assembly fixing hook and the corresponding damper fixing hook may be engaged so as to radially fix the damper element to the drive assembly. The fixing hooks may take any suitable form, for example they may be axially extending and/or may engage at surfaces that form cones, frusto cones or segments thereof.

The damper element may be fixed, for example in all degrees of freedom, to a dimensionally stable component, such as to a drive assembly. For example the damper element may be fixed to a drive assembly using a fixing element. Such a fixing element may take any suitable form, such as a threaded fixing element (such as a bolt) or a rivet. Where a fixing element is used, the engagement load may be adjusted by adjusting the fixing element, for example tightening and/or loosening the fixing element.

The damper element may be (at least) radially fixed to any part of a drive assembly. For example, the drive assembly may comprise a drive arm to which the damper element may be (at least) radially fixed, for example at an inner radial extent of the damper element. A drive arm may be considered to be any component that is arranged to transfer torque during operation, for example between a rotating shaft and the blades of the stage. Such a drive arm may, for example, extend between a shaft and a disc or ring on which the platform may be provided. By way of further example, the drive arm may transfer torque across the axial space between neighbouring rotor stages and may be referred to as a spacer. The drive assembly may also be considered to include a disc or ring on which the platform may be provided.

In any arrangement, the damper engagement surface may be at a radially outer end region of the damper element. For example, the damper engagement surface may form an outermost annular surface (or annular segment) of the damper element.

The platform may have a groove (or slot) formed therein. Such a groove may be formed in a radially inner surface of the platform, which may be on the side of the platform that is opposite to the side from which the blades extend. The damper element may be retained in and/or by such a groove. The damper element may be said to sit in and/or be located by and/or at least partly located in such a groove.

The groove may have a generally U-shaped cross-section and/or may be formed by two surfaces extending in a radial-circumferential plane separated and joined by a surface extending in the axial-circumferential direction. The platform engagement surface may be a part of such a groove. For example, one or two surfaces of the grove extending in a substantially radial-circumferential plane may be platform engagement surface(s).

In general, regardless of whether a groove is provided, one or more than one platform engagement surface may be provided, each platform engagement surface engaging with a corresponding damper engagement surface. Where two or more platform engagement surfaces are provided, they may be axially offset from each other.

The damper element and the platform may be axially biased together. Such an axial bias may provide an engagement load between the damper engagement surface and the platform engagement surface. The engagement load may be referred to as a pre-load. The engagement load may be pre-determined (for example selected through testing and/or modelling) to provide the optimum damping.

Any suitable engagement load may be used. The value of engagement load may depend on, for example, the geometry and/or material and/or mechanical properties (for example stiffness and/or coefficient of friction) of the rotor stage and/or the gas turbine engine in which the rotor stage is provided. The value of the engagement preload may depend on, for example, the relative movement between the damper engagement surface and the platform engagement surface which may itself depend on the flexibility of the platform and/or stiffness of the damper element.

Purely by way of example, the engagement load may be (or result in an engagement pressure that is) in the range of from 1 MPa to 100 MPa, for example 2 MPa to 50 MPa, for example 5 MPa to 40 MPa, for example 10 MPa to 30 MPa, for example on the order of 20 MPa. However, of course, engagement loads below 2 MPa and above 100 MPa are also possible, depending on the application.

The rotor stage may comprise a biasing element. Such a biasing element may urge the platform engagement surface and damper engagement surface together, for example to provide an engagement load. For example, the biasing element may provide a force in the axial direction to the damper element to push the damper engagement surface onto the platform engagement surface. Such a biasing element may take any suitable form, such as a clip and/or a spring. A biasing element may be useful, for example, in providing a particularly consistent engagement load over time, for example regardless of any wear (and thus dimensional and/or tolerance change) that may have taken place over time, for example at the interface of the platform engagement surface and damper engagement surface.

The rotor stage may take any suitable form. For example, the plurality of blades may be formed integrally with the platform (for example as a unitary part), as a blisk. In such an arrangement, the platform may be the rim of the blisk. The rotor stage may comprise a disc on which the platform is provided. Arrangements having integrated disc, platform and blades may be referred to as a blisk. Arrangements having an integrated disc and platform but no disc may be referred to as a bling (bladed ring), although the term blisk as used herein may be used to refer to any arrangement (blisk or bling) having an integrated platform and blades, regardless of whether a disc is also provided.

In any arrangement, a lubricant, such as a dry film lubricant, may be provided between the platform engagement surface and the damper engagement surface. Such a lubricant may assist in providing a particularly consistent coefficient of friction at the engagement surface, for example during use and/or over time.

Whilst the arrangements described herein focus on providing the damper element on a radially inner side of the platform, it will be appreciated that the damper element could be provided on any suitable surface of the platform, for example on a radially outer side of the platform, for example on the same side as that from which the blades extend. The damper engagement surface may, for example, engage a platform engagement surface that is at (or that forms) and axially forward or axially reward surface of the platform, for example.

According to an aspect, there is provided a gas turbine engine comprising at least one rotor stage as described and/or claimed herein.

Any feature described and/or claimed herein, for example in relation to any one of the above features, may be applied/used singly or in combination with any other feature described and/or claimed herein, except where mutually exclusive.

BRIEF DESCRIPTION OF THE DRAWINGS

Non-limitative examples will now be described with reference to the Figures, in which.

DETAILED DESCRIPTION OF EMBODIMENTS

Figure 1:
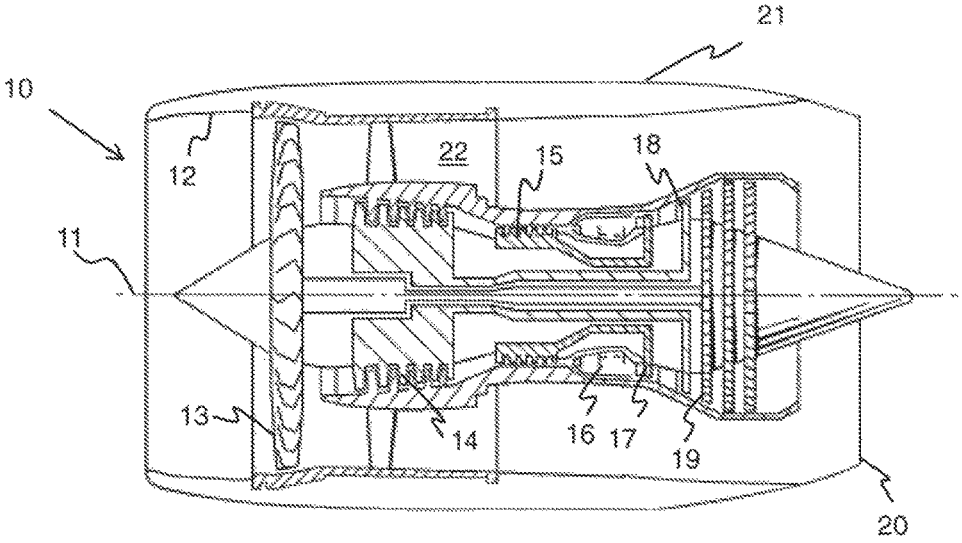
FIG. 1 is a sectional side view of a gas turbine engine in accordance with an example of the present disclosure.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, and intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Each of the high 17, intermediate 18 and low 19 pressure turbines and each of the fan 13, intermediate pressure compressor 14 and high pressure compressor 15 comprises at least one rotor stage having multiple blades (or aerofoils) that rotate in use. One or more rotor stage may be, for example, a disc with slots (which may be referred to as dovetail slots or fir-tree slots) for receiving the blade roots. One or more rotor stages may have the blades formed integrally with the supporting disc or ring structure, and may be referred to as blisks or blings. In such arrangements, the blades may be permanently attached to the supporting disc/ring, for example using friction welding, such as linear friction welding.

Figure 2:
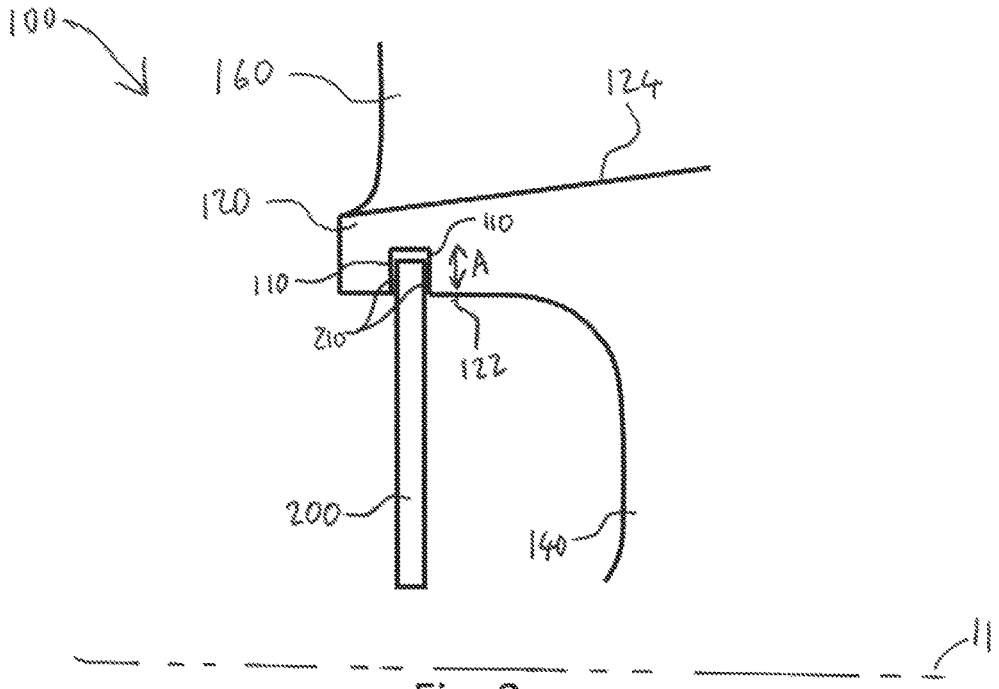
FIG. 2 is a schematic view of a part of a rotor stage of a gas turbine engine, including a damper element, in accordance with an example of the present disclosure.

FIG. 2 shows a schematic side view of a part of a rotor stage 100, including a platform 120, a disc 140, a blade 160, and a damper element 200 (which may be a damper ring 200). The platform 120, disc 140 and blade 160 may all be integral, and may be referred to collectively as a blisk. The rotor stage 100 may be any one of the rotor stages of the gas turbine engine 10 shown in FIG. 1, such as (by way of non-limitative example) the fan 13 and/or any one or more stages of one or more of the high 17, intermediate 18 and low 19 pressure turbines and/or the high pressure compressor 15 or intermediate pressure compressor 14.

In the FIG. 2 example, the damper element 200 is provided to the lower (or radially inner) side 122 of the platform 120. In other arrangements the damper element 200 may engage with another part of the platform 120 such as, by way of example, an upper (or radially outer) surface 124 of the platform 120. The damper element 200 may take many different forms, for example in terms of geometry and/or materials. Purely by way of example, the damper element may be circumferentially continuous (for example in the form of a ring) and/or may be axisymmetric. By way of alternative example, the damper element may only extend around a circumferential segment.

The damper element 200 has a damper engagement surface 210. The damper engagement surface 210 extends in the radial-circumferential direction in the FIG. 2 arrangement. The rotor stage 100 may have two damper engagement surfaces 210, as in the FIG. 2 example, in which the two damper engagement surfaces are offset in the axial direction and parallel to each other. Each engagement surface 210 in the FIG. 2 example is at a radially outer portion or region of the damper element 200. In this regard, the axial direction 11 is towards the right of the page in FIG. 2, the radially outward direction is towards the top of the page, and the circumferential direction is perpendicular to the page. Accordingly, the rotor stage 100 is shown in cross-section normal to the circumferential direction in FIG. 2.

The (or, in arrangements such as that of FIG. 2, each) damper engagement surface 210 engages a corresponding platform engagement surface 110. The platform engagement surface(s) 110 are of the same (or overlapping) shape as the damper engagement surface(s) 210. The platform engagement surface(s) 110 and the damper engagement surface(s) 210 may be annular, as in the FIG. 2 example.

In use, excitation or vibration may cause a circumferential travelling wave to pass around the platform 120. This may be referred to as diametral mode excitation. At a given circumferential position around the circumference, such as at the cross section shown in FIG. 2, this may cause the platform to oscillate in the radial direction. As such, a given circumferential position on the platform 120 may move radially inwardly and outwardly, as illustrated by the arrow A in FIG. 2. This vibration/oscillation around the platform may, of course, occur during use of any arrangement described and/or claimed herein.

The platform engagement surface(s) 110 therefore may also experience this radial oscillation during use. However, the damper engagement surface(s) 210 do not oscillate, or at least any oscillation is of a significantly lower magnitude than that of the corresponding platform engagement surface(s). This may be because the damper element 200 is not directly fixed to the platform 120. Accordingly, the vibration/excitation of the platform results in relative movement between the platform engagement surface(s) (110) and the damper engagement surface(s) 210. Accordingly, the arrow A in FIG. 2 may be taken to represent the relative movement between the platform engagement surface(s) (110) and the damper engagement surface(s) 210. This relative radial movement results in friction at the interface of the engagement surfaces 110, 210. This friction may result in energy dissipation at the interface, and may provide damping of the oscillation/vibration.

The magnitude of the damping may depend upon, amongst other factors, the engagement load between the engagement surfaces 110, 210. The engagement mode may be the normal load pushing the two engagement surfaces 110, 210 together, for example in the axial direction in FIG. 2. In the FIG. 2 example, this normal load is provided by an interference fit of the damper element 200 in a groove 180. The groove 180 is formed in the inner surface 122 of the platform 120. The groove 180 comprises the first and second engagement surfaces 110, joined by an axially extending surface, which may be a cylindrical surface, as in the FIG. 2 example.

Figure 3:
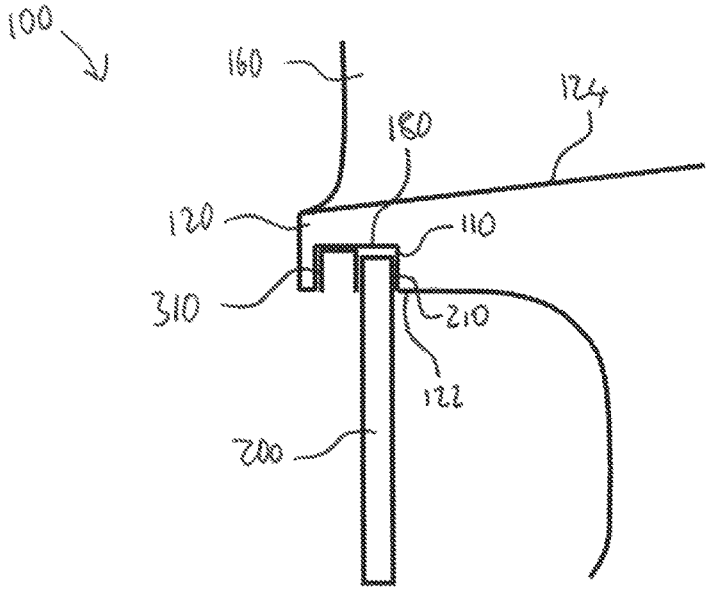
FIG. 3 is a schematic view of a part of a rotor stage of a gas turbine engine, including a damper element, in accordance with an example of the present disclosure.
Figure 4:
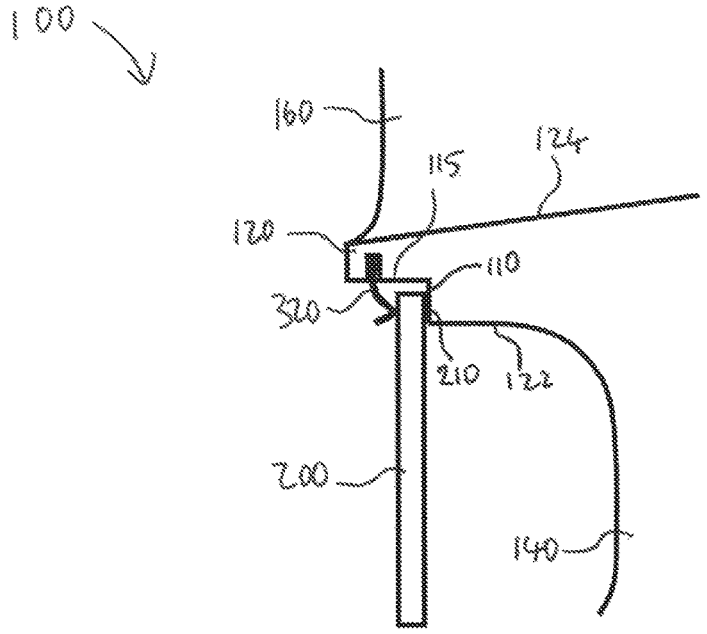
FIG. 4 is a schematic view of a part of a rotor stage of a gas turbine engine, including a damper element, in accordance with an example of the present disclosure.

Alternatives to the interference fit of the FIG. 2 example are shown in FIGS. 3 and 4, which may otherwise be constructed and operate as described in relation to FIG. 2, with like features being represented by like reference numerals.

The FIG. 3 arrangement also has a groove 180 formed in the platform 120. However, unlike the FIG. 2 arrangement, in the groove 180 of the FIG. 3 arrangement is wider (for example extends over a greater axial distance) than the damper element 200. The FIG. 3 arrangement has just one damper engagement surface 210 that engages with just one platform engagement surface 110. The two engagement surfaces 110, 210 are pushed together by a biasing element 310. Accordingly, the biasing element provides the engagement load to press the engagement surfaces 110, 210 together. The biasing element 310 may be provided in the groove 180, for example axially offset from and/or adjacent the damper element 200, as in the FIG. 3 example. The biasing element 310 may take any suitable form, such as a spring and/or a clip. In the FIG. 3 example, the biasing element 310 may be referred to as a clip 310, and may further be described as a u-shaped clip.

The FIG. 4 arrangement is similar to that of FIG. 3, other than in that it does not have a groove 180 and the biasing element 320 has a different form. Instead of being located in a groove, the damper element 200 is simply biased towards a platform engagement surface by a biasing element 320. FIG. 4 shows an example of an arrangement in which the platform engagement surface 210 is provided by way of a notch (or open notch) 115. Such a notch 115 may be formed in the radially inner surface 122 of the platform 120, as in the FIG. 4 example. Again, the biasing element 320 could take any suitable form, such as the spring 320 located and/or fixed in the platform 120 shown in the FIG. 4 example.

In general using a biasing element 310, 320 may allow the engagement load to be maintained at substantially the same level throughout the service life of the damper arrangement. For example, any wear/dimensional change over time (for example due to the friction at the interface of the engagement surfaces 110, 210) may be compensated for (for example passively) by the biasing element, such that the force provided by the biasing element, and thus the engagement load, remains substantially constant over time.

As explained elsewhere herein, the relative movement of the damper engagement surface 210 and the platform engagement surface 110 may result in energy dissipation, and thus vibration damping. This relative movement may be relative radial movement (or at least predominantly radial movement with, for example, some circumferential movement) and may rely on the damper engagement surface 210 being more radially fixed in position during operation (for example during diametral mode excitation of the rotor stage 100) than the platform engagement surface 110. In some arrangements, the damper engagement element 200 may be shaped (for example in cross section perpendicular to the circumferential direction) to be particularly stiff in the radial direction.

Purely by way of example, the damper element 200 may have a simple rectangular cross section perpendicular to the circumferential direction. Such a rectangular cross section may be longer in the radial direction than in the axial direction. The schematic damper elements of FIGS. 2 to 4 are examples of dampers 200 having such rectangular cross sections.

Purely by way of further example, the cross sectional shape may comprise one or more axial protrusions. For example, the damper element 200 shown by way of example in FIG. 5 has a cross section that comprises two axial protrusions 260 in cross section. The example shown in FIG. 5 may be said to have an I-shaped cross section. A damper element 200 having such a cross section may have increased stiffness compared with one of the same mass but having a rectangular cross section. However, it will be appreciated that a damper element 200 may have any suitable cross sectional shape, including but not limited to those described and/or illustrated herein by way of example.

Figure 5:
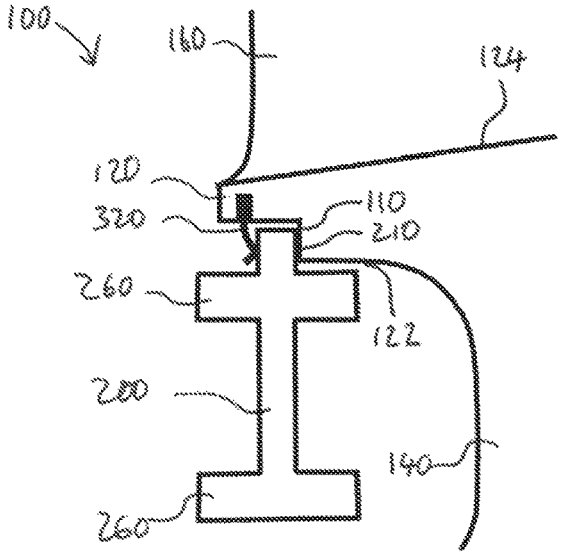
FIG. 5 is a schematic view of a part of a rotor stage of a gas turbine engine, including a damper element, in accordance with an example of the present disclosure.

Other than in the cross sectional shape of the damper element 200, the rotor stage 100 shown in FIG. 5 may be the same as that shown in FIG. 4. The FIG. 5 example is shown with a spring 320 biasing the damper element 200 towards the engagement surface 110. However, it will be appreciated that the rotor stage 100 of FIG. 5 may have any one of the other features described and/or claimed herein, such as a clip 310 and/or a groove 180.

The resistance of the damper engagement surface 210 to radial movement may optionally be increased by radially fixing the damper element 200 to a part of the gas turbine engine 10 that is dimensionally (or at least radially and optionally also circumferentially) very stable in operation. Such a part of the gas turbine engine may rotate with the rotor stage 100 and/or be a part of the rotor stage 100. A drive assembly, for example including a drive arm and/or a spacer 190 and/or a disc 140, may be used as such a dimensionally stable part of the engine that rotates with the rotor stage. Such a drive assembly may be arranged to transfer torque within the engine 10. Also purely by way of example, an inner radial portion of the damper element 200 may be radially fixed to the dimensionally stable part.

Figure 6:
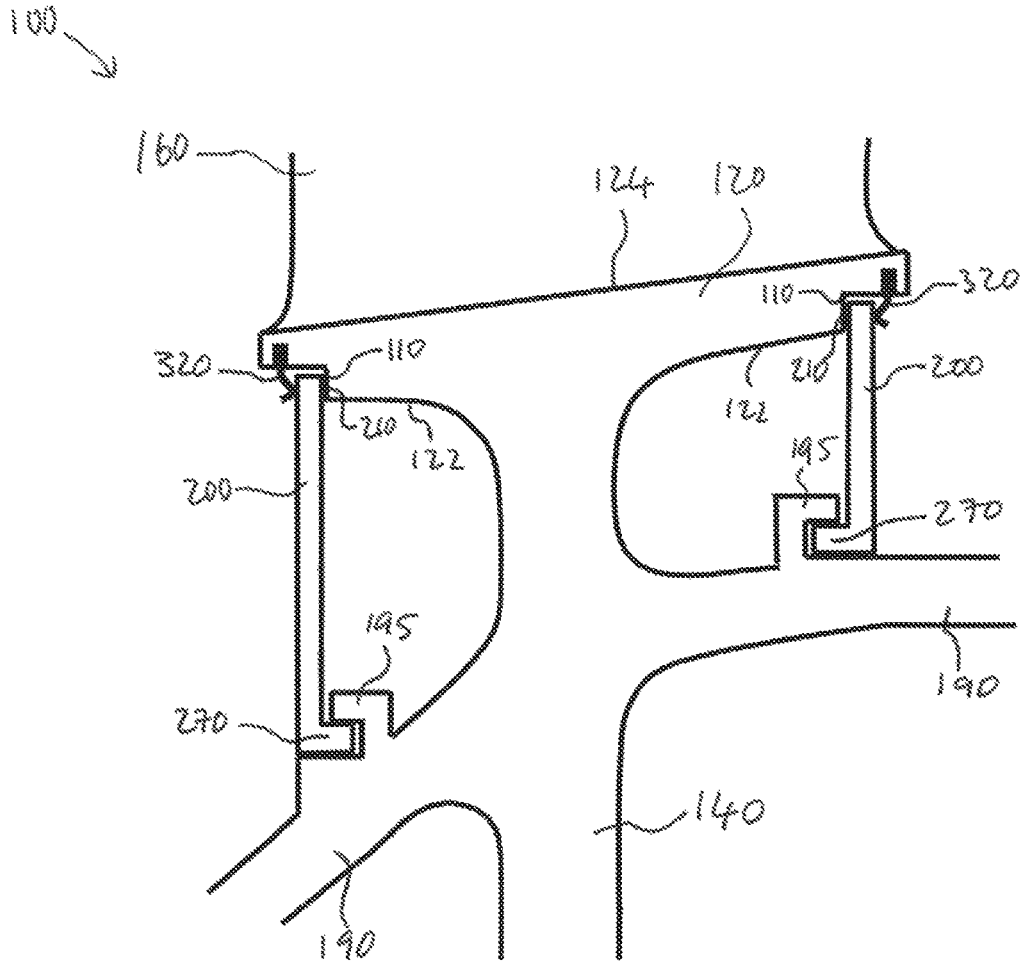
FIG. 6 is a schematic view of a part of a rotor stage of a gas turbine engine, including a damper element, in accordance with an example of the present disclosure.

The exemplary rotor stage shown in FIG. 6 comprises a damper element 200 with a damper fixing hook 270 that radially fixes the damper element 200 to a dimensionally stable part, in this case a drive arm 190. The damper fixing hook 270 may be described as having an axially protruding portion and/or a circumferentially extending hook locating surface. The damper fixing hook 270 is connected to a corresponding drive arm fixing hook 195. The two fixing hooks 270, 195 cooperate to radially fix the damper element 200 to the drive arm 190.

Figure 7:
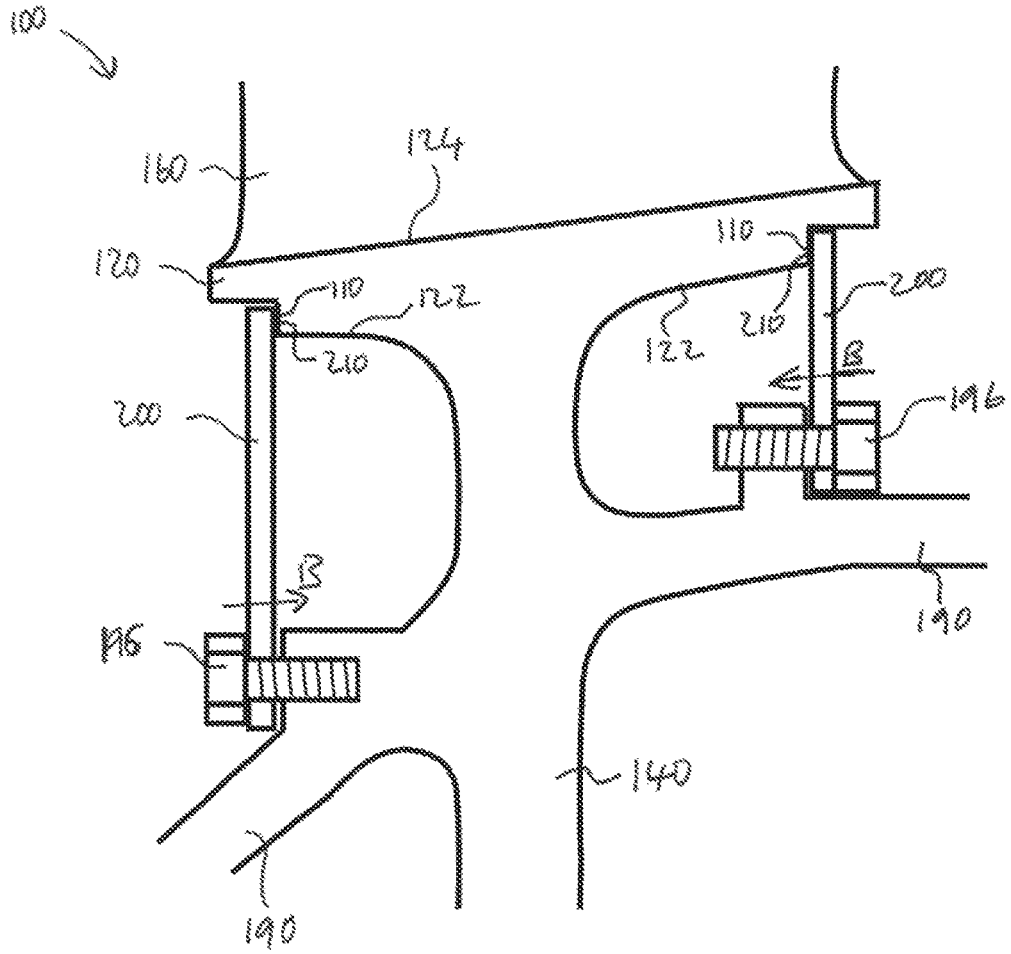
FIG. 7 is a schematic view of a part of a rotor stage of a gas turbine engine, including a damper element, in accordance with an example of the present disclosure.

FIG. 7 shows, by way of further example, an alternative arrangement for radially fixing the damper element 200 to a drive assembly 190, in this case using a treaded fastener in the form of a bolt 196. The bolt 196 is tightenable in an axial direction indicated by the arrow B in FIG. 7. In addition to fixing the damper element 200 relative to the drive assembly 190, using a threaded fastener 196 may allow the engagement load of the damper engagement surface 210 against the platform engagement surface 110 to be adjusted and/or set as desired. For example, the engagement load may be adjusted by tightening (for example to increase the engagement load) or loosening (for example to decrease the engagement load) the threaded fastener 196. This may be useful, for example, either to set the engagement load to the desired in-service level and/or to adjust the engagement load during development/design of the damper assembly in order to determine the optimal engagement load. Thus, of course, the bolt (or other fastening element) 196 is an example of a biasing element.

The examples shown in FIGS. 6 and 7 comprise two damper elements 200, which are axially separated from each other. However, other arrangements may be as described in relation to FIG. 6 or FIG. 7, but instead comprise just one (or indeed more than two) damper elements 200. Similarly, other features such as the cross sectional shape of the damper elements 200 and the presence/form of the biasing elements 196, 320 are, of course, only exemplary in the arrangements of FIGS. 6 and 7 and may take different forms, such as (for example) those described and/or claimed elsewhere herein.

It will be understood that the invention is not limited to the arrangements and/or examples above-described and various modifications and improvements can be made without departing from the concepts described and/or claimed herein. Except where mutually exclusive, any of the features may be employed separately or in combination with any other features and the disclosure extends to and includes all combinations and sub-combinations of one or more features described and/or claimed herein.

I claim:

1. A rotor stage for a gas turbine engine comprising:

a plurality of blades extending from a platform, the platform extending circumferentially about an axial direction; and a circumferentially extending damper element, wherein:

the platform comprises a platform engagement surface that extends in a plane that is substantially perpendicular to the axial direction;

the damper element comprises a damper engagement surface that extends in a plane that is parallel to and engages with the platform engagement surface; and the damper engagement surface and the platform engagement surface are moveable relative to each other in a radial direction (A), a stiffness of the platform being less than a stiffness of the damper element in the radial direction such that the platform is more radially deformable than the damper element under diametral mode excitation of the rotor stage.

2. The rotor stage according to claim 1, wherein the platform engagement surface is annular.

3. The rotor stage according to claim 1, wherein the damper element is a damper ring, and the damper engagement surface is annular.

4. The rotor stage according to claim 1, wherein the damper element has a cross-sectional shape in a plane perpendicular to the circumferential direction of the rotor stage that is stiffer about an axially extending bending axis than about a radially extending bending axis.

5. The rotor stage according to claim 4, wherein the dimension of the cross-section in the radial direction is greater than the dimension of the cross-section in the axial direction.

6. The rotor stage according to claim 1, wherein the damper element is a thin-walled annular disc.

7. The rotor stage according to claim 1, wherein the damper element comprises at least one axially extending stiffening rib.

8. The rotor stage according to claim 1, further comprising a drive assembly arranged to transfer torque to/from the platform, wherein the damper element is radially fixed to the drive assembly.

9. The rotor stage according to claim 8, wherein the damper element extends from a radially inner end to a radially outer end; and the radially inner end region of the damper element is radially fixed to the drive assembly.

10. The rotor stage according to claim 8, wherein the drive assembly comprises a fixing hook that is engaged with a corresponding damper fixing hook to radially fix the damper element to the drive assembly.

11. The rotor stage according to claim 8, wherein the damper element is fixed to the drive assembly using a fixing element.

12. The rotor stage according to claim 1, wherein the damper engagement surface is at a radially outer end region of the damper element.

13. The rotor stage according to claim 1, wherein:

the platform engagement surface is part of a groove formed in a radially inner surface of the platform.

14. The rotor stage according to claim 1, wherein the damper element and the platform are axially biased together, thereby providing an engagement load between the damper engagement surface and the platform engagement surface.

15. The rotor stage according to claim 1, further comprising a biasing element that provides a force in the axial direction to the damper element to push the damper engagement surface onto the platform engagement surface.

16. The rotor stage according to claim 1, wherein the plurality of blades are formed integrally with the platform.

17. A gas turbine engine comprising the rotor stage according to claim 1.

18. A method of damping vibrations in a rotor stage of a gas turbine engine, wherein:

the rotor stage is a rotor stage according to claim 1;

the vibration comprises a travelling wave passing circumferentially around the circumferentially extending platform; and the damping is frictional damping generated through radial slip between the platform engagement surface and the damper engagement surface.

19. A method of designing a rotor stage of a gas turbine engine, the rotor stage having a plurality of blades extending from a platform, the platform extending circumferentially about an axial direction and comprising a platform engagement surface that extends in a plane that is substantially perpendicular to the axial direction, the method comprising:

providing a damper element comprising a damper engagement surface that extends in a plane that is parallel to the platform engagement surface and engages with the platform engagement surface, the damper engagement surface and the platform engagement surface are moveable relative to each other in a radial direction (A), a stiffness of the platform being less than a stiffness of the damper element in the radial direction such that the platform is more radially deformable than the damper element under diametral mode excitation of the rotor stage;

providing a rig having the same vibration response and platform engagement surface as the platform;

the rig being more radially flexible than the damper element under diametral mode excitation;

providing an axial biasing force to push the damper engagement surface and platform engagement surface of the rig together; and providing diametral mode excitation to the rig and measuring the damping provided by the damper element, wherein:

the method further comprises:

repeating the step of providing diametral mode excitation and measuring the damping at different axial biasing forces; and determining, from the measured damping, the optimal axial biasing force required to provide optimal damping of the diametral mode excitation.

20. A method of manufacturing a rotor stage of a gas turbine engine comprising:

providing a platform extending circumferentially about an axial direction, the platform having a plurality of blades extending therefrom and a platform engagement surface that extends in a plane that is substantially perpendicular to the axial direction;

providing a damper element having a damper engagement surface that extends in a plane that is parallel to the platform engagement surface and engages with the platform engagement surface;

wherein the damper engagement surface and the platform engagement surface are moveable relative to each other in a radial direction (A), a stiffness of the platform being less than a stiffness of the damper element in the radial direction such that the platform is more radially deformable than the damper element under diametral mode excitation of the rotor stage, providing a rig having the same vibration response and platform engagement surface as the platform, the rig being more radially flexible than the damper element under diametral mode excitation;

providing an axial biasing force to push the damper engagement surface and the platform engagement surface of the rig together; and providing diametral mode excitation to the rig and measuring the damping provided by the damper element;

repeating the step of providing diametral mode excitation and measuring the damping at different axial biasing forces; and determining, from the measured damping, the optimal axial biasing force required to provide optimal damping of the diametral mode excitation; and biasing the damper engagement surface and the platform engagement surface of the platform together using the optimal biasing force.

* * * * *